US007121715B1

(12) United States Patent
Bongratz

(10) Patent No.: US 7,121,715 B1
(45) Date of Patent: Oct. 17, 2006

(54) VARIABLE HEIGHT, MULTIPLE POSITION BATCH BLENDER ASSEMBLY

(75) Inventor: Howard W. Bongratz, Gurnee, IL (US)

(73) Assignee: Eirich Machines, Inc., Gurnee, IL (US)

( * ) Notice: Subject to any disclaimer, the term of this patent is extended or adjusted under 35 U.S.C. 154(b) by 205 days.

(21) Appl. No.: 10/806,596

(22) Filed: Mar. 23, 2004

(51) Int. Cl.
*B01F 7/04* (2006.01)

(52) U.S. Cl. ..... 366/192; 366/194; 366/331

(58) Field of Classification Search ..... 366/26, 366/23, 192–194, 212, 240, 331
See application file for complete search history.

(56) References Cited

U.S. PATENT DOCUMENTS

| | | | | | |
|---|---|---|---|---|---|
| 689,170 | A | * | 12/1901 | Dragoo et al. | 366/203 |
| 968,739 | A | * | 8/1910 | Carlson | 366/26 |
| 1,065,607 | A | | 6/1913 | Hennessy | |
| 1,324,960 | A | | 12/1919 | Gasteiger | |
| 1,332,063 | A | * | 2/1920 | Powers | 366/26 |
| 1,533,950 | A | | 4/1925 | Schlick | |
| 1,943,194 | A | * | 1/1934 | Vachoux | 366/192 |
| 2,387,024 | A | * | 10/1945 | Hishon et al. | 422/49 |
| 2,416,748 | A | | 3/1947 | Gnoerk | |
| 2,739,804 | A | | 3/1956 | Funderburk, Jr. | |
| 3,145,976 | A | | 8/1964 | August et al. | |
| 4,006,260 | A | | 2/1977 | Webb et al. | |
| 4,127,947 | A | | 12/1978 | Webb et al. | |
| 4,525,070 | A | | 6/1985 | Gressette, Jr. | |
| 5,090,815 | A | * | 2/1992 | Bohle | 366/192 |
| 5,474,379 | A | | 12/1995 | Perry | |

FOREIGN PATENT DOCUMENTS

| | | |
|---|---|---|
| DE | 90 01 012.4 | 6/1990 |
| DE | 3921143 A1 | 1/1991 |
| GB | 903592 | 8/1962 |

* cited by examiner

*Primary Examiner*—David Sorkin
(74) *Attorney, Agent, or Firm*—Mathew R. P. Perrone, Jr.

(57) ABSTRACT

A liftable blender assembly has a container, which is easily filled and emptied in that it may be loaded with ingredients from the top, may cause the ingredients to mix or react, may be raised and then may be emptied from the bottom.

5 Claims, 3 Drawing Sheets

VARIABLE HEIGHT, MULTIPLE POSITION BATCH BLENDER ASSEMBLY

This invention relates to a blender and more particularly to a variable height and multiple position batch blender assembly having a batch blender mounted within a lifting system, which can be easily filled with ingredients to be mixed or reacted, and easily emptied after a desired procedure to provide a product is performed on the ingredients in the liftable blender.

BACKGROUND OF THE INVENTION

With a mixer, especially an industrial batch mixer, it is very desirable to easily load and empty the mixer. When the mixer is loaded, various ingredients are added. Each ingredient, by itself, is usually easily handled. After the ingredients are mixed, at least a physical intermixture takes place. Also, a chemical reaction may take place. For the sake of discussion, it is assumed that both of these procedures form a product.

Whatever happens between the ingredients in the mixer to form a product, that product must be recovered from the mixer. It is very desirable to empty the mixer or recover the product in an appropriate fashion. Since the product is usually heavier than the ingredients, that extra weight renders that recovery difficult.

Adding ingredients to or removing a product from a batch mixer creates a number of ergonomic problems. Lifting of heavy items is always difficult and can be dangerous. Efficiently removing a product from a batch mixer requires great care and efficiency in order to have an effective procedure.

Customarily, a batch mixer can require stairs or a platform in order to provide appropriate access thereto. Such structures greatly increase the amount of floor space required for a batch mixer. If an efficient batch mixer can be developed, which minimizes the use of floor space, great advantages are obtained.

Various types of ancillary equipment are usually required for a batch mixer. Such equipment takes up space and complicates the manufacturing process. Any reduction in such equipment also offers great advantages.

Furthermore, recovery of a product and adding of a plurality of ingredients combine to cause a substantial number of problems. That which can assist in the recovery of a product can interfere with the addition of ingredients function. That which can assist with the addition of ingredients function can interfere with the recovery of a product.

It is also well recognized that the ingredients added to the mixer can require a variety of different parameters for the structure of the mixer. For example, if concrete is being made, heavy-duty characteristics are more critical than sanitary characteristics. If a food product is being formed, sanitary characteristics become extremely critical.

Many times, accessibility to a batch mixer is limited. Such limitations interfere with the use of that mixer and complicate the manufacturing process. For example, in a food system, it is critical for that mixer to be easily cleaned. So if accessibility to a batch mixer can be improved, the batch mixer becomes much easier to clean.

Whatever product is formed by the mixer, an efficient recovery mechanism offers a great advantage. In other words, if the product may be advanced to the next step in the process, in an efficient manner, great advantages are attained. If recovery gets the product to a point of use efficiently, costs can be reduced and other advantages obtained.

SUMMARY OF THE INVENTION

Among the many objectives of this invention is the provision of a liftable blender, which allows for top loading of raw materials and bottom recovery of a product.

A further objective of this invention is the provision of a liftable blender with a lifting system to facilitate product recovery.

Yet a further objective of this invention is the provision of a liftable blender utilizing one operator.

A still further objective of this invention is the provision of an ergonomic liftable blender.

Yet another objective of this invention is the provision of a liftable blender, which saves space.

Yet another objective of this invention is the provision of a liftable blender with a low-profile, loading position.

Still, another objective of this invention is the provision of an accessible liftable blender.

Also, an objective of this invention is the provision of an accessible liftable blender, which may be easily cleaned.

In addition, an objective of this invention is the provision of an accessible liftable blender with the capability of mixing products while the receiver is in a low position.

These and other objectives of the invention (which other objectives become clear by consideration of the specification, claims and drawings as a whole) are met by providing a liftable blender which is easily filled and emptied in that it may be loaded with ingredients from the top, may cause the ingredients to mix or react, may be raised and then may be emptied from the bottom.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
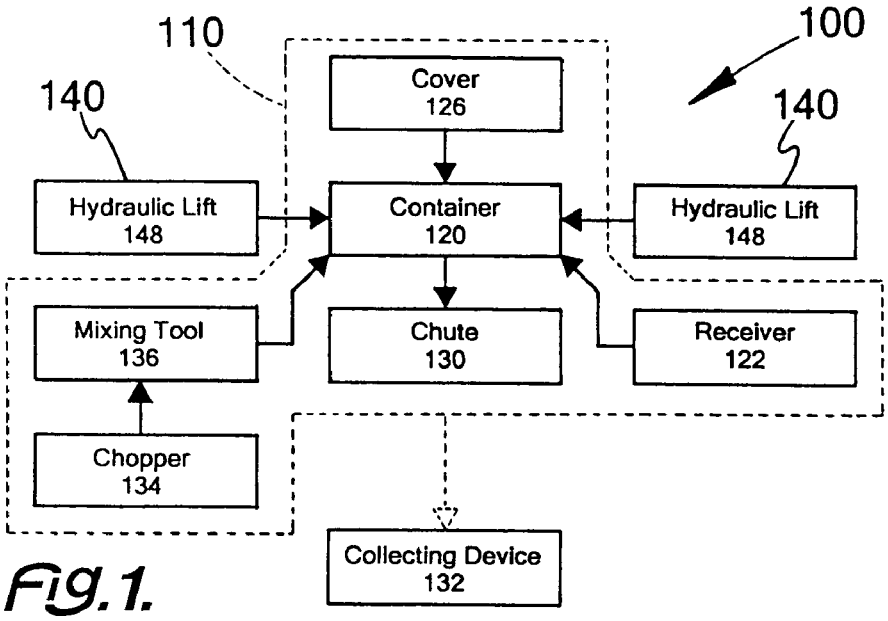
FIG. 1 depicts a block diagram for a variable height and multiple position batch blender assembly 100 of this invention.

The variable height and multiple position batch blender assembly of this invention has a batch blender mounted within a lifting system. The batch blender includes a container and an agitator mounted in the container.

The lifting system permits the batch blender to be lowered for filling and raised for the purpose of discharging materials contained therein. Also, the batch blender may achieve mixing of materials therein by rotation of an agitator mounted therein. Such rotation moves the materials or ingredients therein in at least one specific direction in order to form a desired product.

The agitator may have a variety of tools mounted thereon in order to achieved a desired type of mixing. Preferably, the blender has a chopping mechanism or a horizontal agitator mounted therein. This horizontal agitator rotates about a horizontal axis. The types of tools mounted on the agitator are empirically determined, based on the properties of the ingredients being mixed.

However, the preferred mixing of materials therein is achieved by rotation of an agitator mounted therein. The blender has a horizontal agitator that rotates at least partially in at least one direction. A variety of tools may be attached to the agitator. The particular types of tools on the agitator are selected to create a mixing mechanism that is best suited to the physical properties of the ingredients being mixed.

The bottom of the blender has a closeable discharge mechanism to control the flow of a finished product out of the blender. At the top of the blender is a sealable cover, which is removable or openable in order to add ingredients.

With the batch blender in its lowest position, the cover may be opened. As many ingredients as desired are then inserted into the blender. The ingredients are added thereto, and then mixed or reacted by an agitator, mounted within the blender in the appropriate fashion in order to form a product.

After a product is formed, the lifting system raises the blender. An appropriate device for receiving the product is placed under the discharge mechanism. The discharge mechanism is opened, and the product passes into that appropriate device by gravity or other means.

For the batch blender, to assist with the mixing, the container for the batch blender has a base and a cover. An agitator or appropriate mixing device is mounted in the base in a standard fashion. The base of the batch blender is preferably arcuate on an elongated cross-section. Within the elongated cross-section is a closeable discharge mechanism such as a discharge chute. At the top of the batch blender is a sealable cover, which is removable or openable in order to add ingredients to the batch blender.

With the batch blender below the lifting level of the operator, the cover may be opened. As many ingredients as desired are then inserted into the batch blender. The cover is closed in a sealable fashion, in order to contain the ingredients therein. The ingredients are then agitated within the batch blender in the appropriate fashion, in order to form a product.

After the product is formed, the lifting system raises a batch blender. An appropriate device for receiving the product, which has been formed in the batch blender, is placed under the chute. The closeable discharge mechanism is opened, and the product passes into that appropriate device.

Referring now to FIG. 1, variable height and multiple position batch blender assembly 100 has batch blender 110 mounted on lifting carriage assembly 140 in its lowest position, that is loading position 200. Batch blender 110 includes a container 120, which has a receiver 122 releasably closeable by sealable cover 126.

Hydraulic lifts assembly 148, on either end of batch blender 110, positions batch blender 110 for loading container 120 with raw ingredients, or for removal of a product formed from the raw ingredients within batch blender 110, as desired. Such a product formation is accomplished without the operator having to climb or to perform a high lifting operation.

Figure 2:
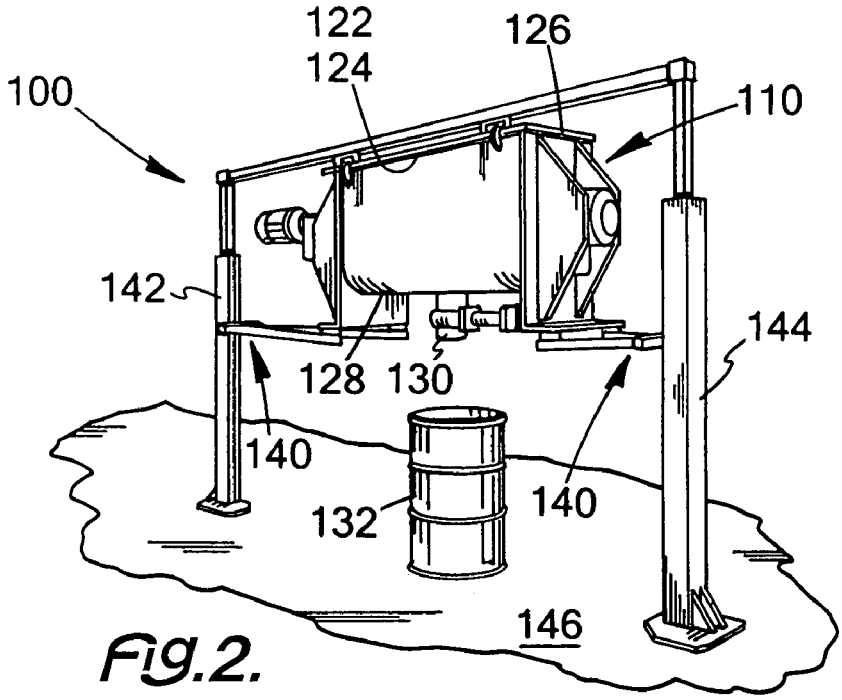
FIG. 2 depicts a perspective view of a variable height and multiple position batch blender assembly 100 of this invention.

Adding FIG. 2 to the consideration, variable height and multiple position batch blender assembly 100 has batch blender 110 mounted on lifting carriage assembly 140 and is in the highest position, that is discharge position 180. Container 120 has a base or receiver 122 with an open top 124. Open top 124 is closed by sealable cover 126. Receiver 122 has an arcuate base 128 oppositely disposed from open top 124. Within arcuate base 128, is a closeable discharge mechanism such as sealable chute 130.

In operation, the variable height and multiple position batch blender assembly 100, and specifically container 120 has sealable cover 126 removed from receiver 122. Ingredients (not shown) are added to receiver 122. Sealable cover 126 is replaced in order to close receiver 122. Batch blender 110 causes mixing of ingredients to form a product. Lifting carriage assembly 140 raises batch blender 110, in order to permit a barrel 132 or other product collection device to be placed under sealable chute 130. Sealable chute 130 is opened thereby allowing the product to flow into barrel 132.

Figure 3:
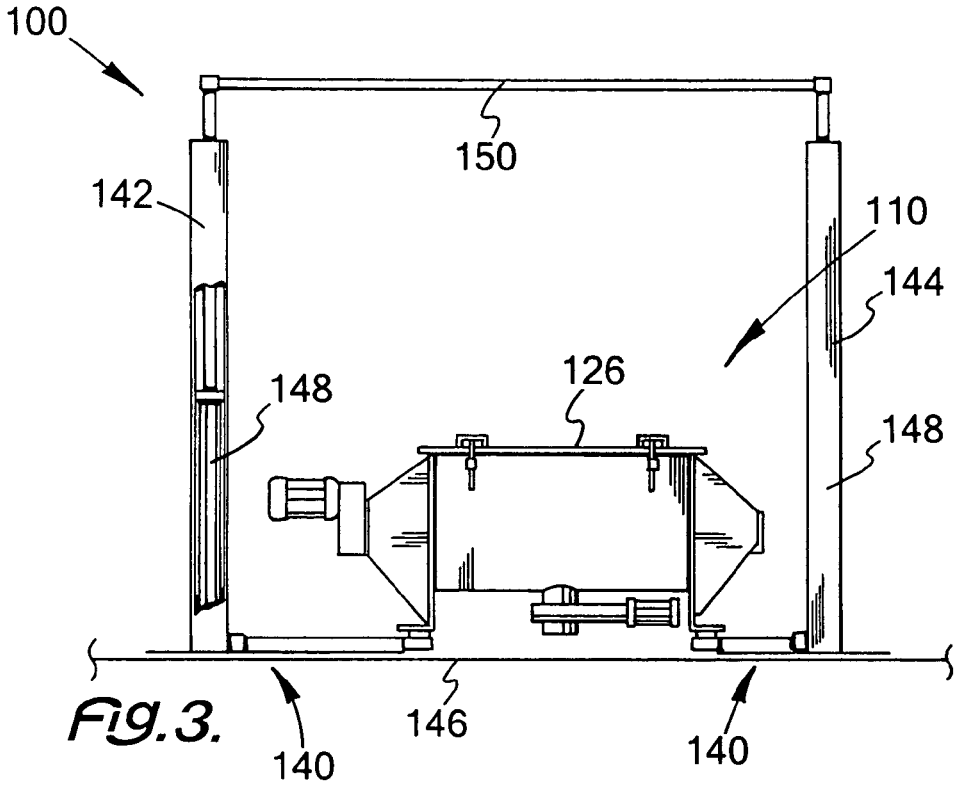
FIG. 3 depicts a side view of a variable height and multiple position batch blender assembly 100 of this invention.
Figure 4:
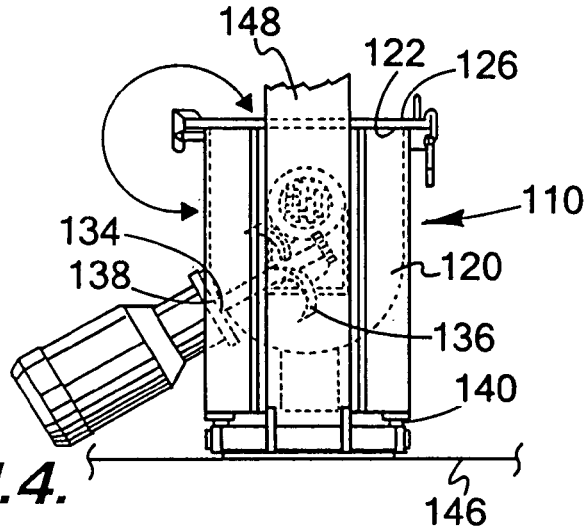
FIG. 4 depicts an end plan view of a batch blender 110 for variable height and multiple position batch blender assembly 100 of this invention.
Figure 5:
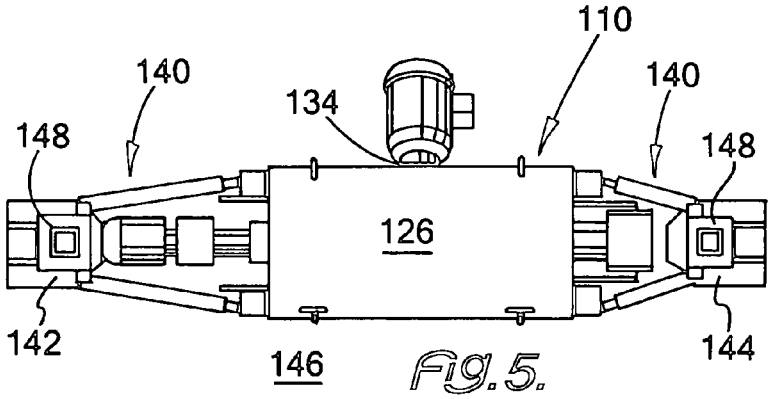
FIG. 5 depicts a top plan view of a batch blender 110 for variable height and multiple position batch blender assembly 100 of this invention.

With the further consideration of FIG. 3, FIG. 4, and FIG. 5, the relationship of batch blender 110 to lifting carriage assembly 140 becomes more clear. The lifting carriage assembly 140 includes a first parallel side arm 142 and a second parallel side arm 144, which are substantially perpendicular to floor 146. Within first parallel side arm 142 and second parallel side arm 144 are hydraulic lifts 148.

With FIG. 4, the position of chopper 134 communicating with container 120 and receiver 122 becomes clear. Chopper 134 drives mixing tool 136, which assists with mixing or reacting of ingredients within batch blender 110. Chopper 134 communicates with receiver 122 through chopper aperture 138 in receiver 122 in a standard fashion.

Figure 6:
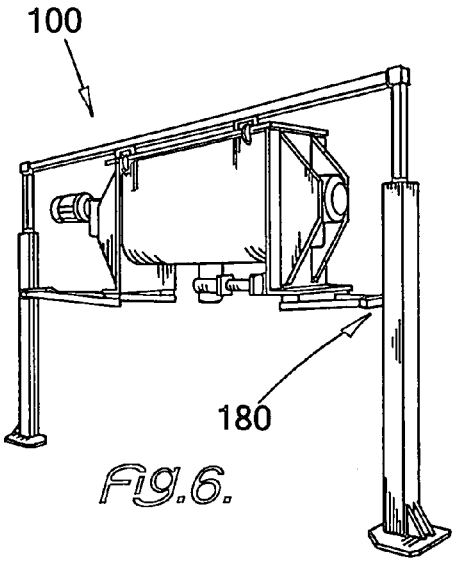
FIG. 6 depicts a perspective view of a variable height and multiple position batch blender assembly 100 of this invention in discharge position 180.
Figure 7:
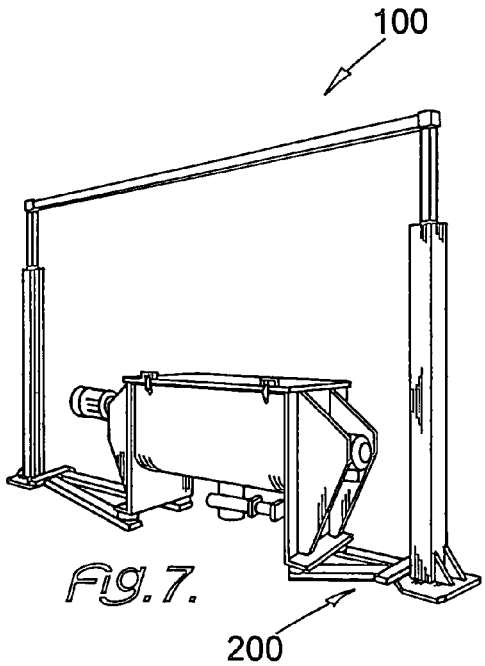
FIG. 7 depicts a perspective view of a variable height and multiple position batch blender assembly 100 of this invention in loading position 200.

Top cross member 150 holds first parallel side arm 142 and second parallel side arm 144 in proper position and cooperates therewith in order to support batch blender 110 for liftable blender 100 thereon, by interconnecting the top ends thereof. Batch blender 110 is moved upwardly by hydraulic lifts 148 to discharge position 180 (FIG. 6). A downward movement of batch blender 110 is moved by hydraulic lifts 148 provides loading position 200 (FIG. 7).

Batch blender 110 is connected at each end to hydraulic lifts 148 in a standard fashion. The hydraulic lift 148 in each of first parallel side arm 142 and of second parallel side arm 144 are coordinated in a standard fashion to keep the horizontal geometric axis of batch blender 110 substantially parallel to floor 146, whether batch blender 110 is in discharge position 180 (FIG. 6) or loading position 200.

Barrel 132 may be replaced by any suitable container. Such a suitable container may be moved into position with any suitable device. If a heavy product is anticipated, a forklift or other such machine of the desired of the desired lifting capability may be used. Barrel 132 may be replaced by a series of smaller containers if desired, as is clear from a consideration of FIG. 1.

This application; taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A variable height and multiple position batch blender assembly comprising:

(a) a batch blender being movably mounted within a hydraulic lifting assembly;

(b) the batch blender having a cover and a receiver;

(c) the batch blender having a filling means and a discharge means;

(d) the batch blender having the capability of placing the receiver in a low position for filling purposes;

(e) the batch blender having the capability of placing the receiver in a high position for discharge purposes;

(f) the lifting assembly supporting the batch blender;

(g) the batch blender having an agitator mounted in the receiver;

(h) the agitator having at least one mixing tool secured in the interior of the receiver;

(i) the receiver having a discharge mechanism mounted therein;

(j) the cover closing the receiver;

(k) the cover being pivotally openable relative to the receiver;

(l) the lifting assembly supporting the receiver;

(m) the discharge means being closeable for filling the receiver;

(n) the cover being pivotally sealable in relation to the receiver in order to close the receiver;

(o) the discharge means being positioned in a bottom portion of the receiver;

(p) the cover closing a top portion of the receiver;

(q) the agitator having at least one mixing tool releasably secured thereto; and (r) the low position allowing for the removal and installation of the cover.

2. The blender assembly of claim 1 further comprising;

(a) the lifting assembly including a first side arm and a second side arm;

(b) the first side arm supporting the receiver at a first receiver side;

(c) the second side arm supporting the receiver at a second receiver side; and (d) a top cross member supporting the first side arm relative to the second side arm.

3. The blender assembly of claim 2 further comprising:

(a) the lifting assembly including a first lifting assembly mounted in the first side arm;

(b) the lifting assembly including a second lifting assembly mounted in the second side arm;

(c) the first lifting assembly being secured to the first receiver side;

(d) the second lifting assembly being secured to the second receiver side; and (e) the first lifting assembly cooperating with the second lifting assembly in order to raise or lower the blender as desired.

4. The blender assembly of claim 3 further comprising:

(a) the first lifting assembly being a first hydraulic lifting assembly;

(b) the second lifting assembly being a second hydraulic lifting assembly;

(c) the first side arm being substantially parallel to the second side arm;

(d) the first side arm and the second side arm having the blender mounted there between;

(e) the first side arm and the second side arm being secured to a floor at a base end thereof;

(f) the top cross member being oppositely disposed from the floor.

5. The blender assembly of claim 4 further comprising:

(a) the receiver having an arcuate base;

(b) the discharge means being a closeable discharge chute;

(c) the closeable discharge chute being in the arcuate base;

(d) the closeable discharge chute having the capability of closing during a filling process or a blending process;

(e) the closeable discharge chute having the capability of opening in order to remove a product from the blender; and (f) the closeable discharge chute being adapted to place the product in a container.

* * * * *